United States Patent [19]

Yi

[11] Patent Number: 4,553,737

[45] Date of Patent: Nov. 19, 1985

[54] PRYING STAPLE REMOVER

[76] Inventor: Chol H. Yi, 1919 Citron St., #901, Honolulu, Hi., 96826

[21] Appl. No.: 707,684

[22] Filed: Mar. 4, 1985

[51] Int. Cl.[4] ..... B25C 11/00

[52] U.S. Cl. ..... 254/28

[58] Field of Search ..... 254/28; 227/63

[56] References Cited

U.S. PATENT DOCUMENTS

| | | | |
|---|---|---|---|
| 2,375,942 | 5/1945 | Palmer | 254/28 |
| 2,400,988 | 5/1946 | Goessel | 254/28 |
| 3,625,482 | 12/1971 | Viel | 254/28 |
| 3,825,226 | 7/1974 | Appleman | 254/28 |
| 4,513,951 | 4/1985 | Rogers | 254/28 |

*Primary Examiner*—Robert C. Watson

*Attorney, Agent, or Firm*—Paul L. Hickman

[57] ABSTRACT

A prying staple remover characterized by a head portion having a curved bottom and top surface, and a pair of side surfaces connecting the bottom surface with the top surface. The side surfaces are each provided with a groove with which the legs of the removed staples may be engaged. The head portion also includes a magnet and magnetic field return assembly which magnetically attracts the bases of the removed staples.

4 Claims, 8 Drawing Figures

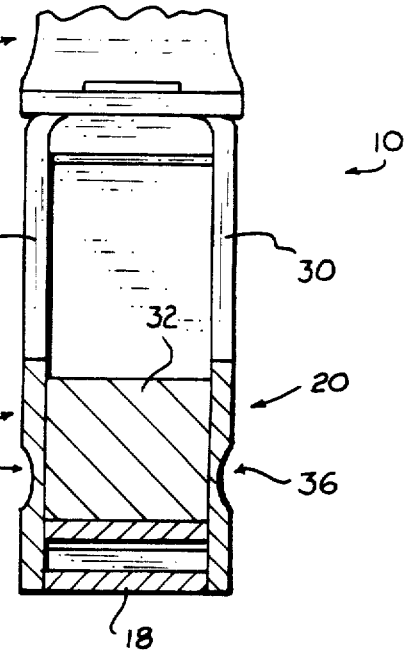
FIG. 5.
FIG. 6a.
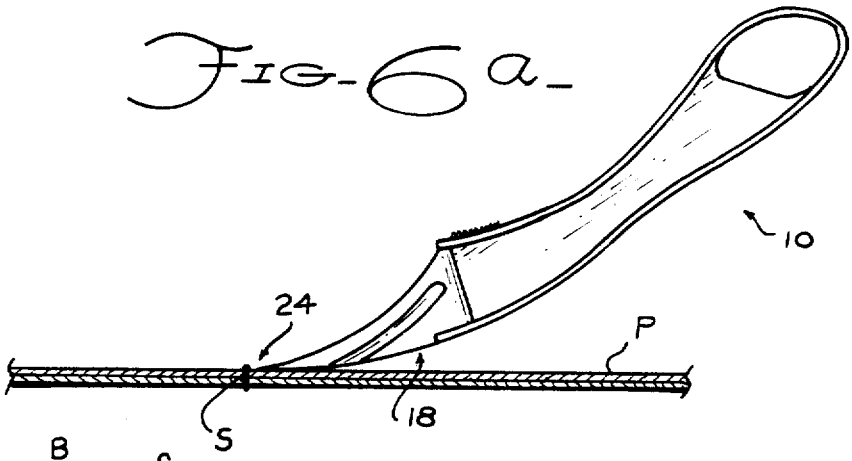
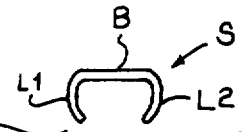
FIG. 6b.
PRIOR ART
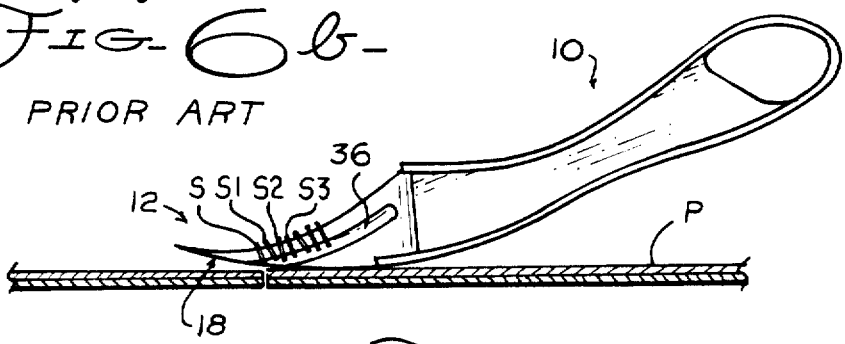
FIG. 6c.

PRYING STAPLE REMOVER

BACKGROUND OF THE IVENTION

1. Field of the Invention

This invention relates generally to devices for removing staples from a stapled object, and more particularly to prying-type staple removers.

2. Description of the Prior Art

There are two major types of staple removers, namely the pincher type remover having a pair of coacting jaws, and a prying type remover. The prying type remover usually includes a long, flat tip which can slide under the base of a staple to pry the legs of the staple from the object to which it is attached. Examples of prying staple removers can be found in U.S. Pat. Nos. 3,825,226 of Appleman, 2,400,988 of Goessel, 2,375,942 of Palmer, and 3,625,482 of Viel.

A problem encountered with prior art prying staple removers is that the used staples may cling to the prying tip and interfere with subsequent staple removal.

Another related problem with prior art prying staple removers is the disposal of the used staples. In the Viel patent, this problem is addressed with a device including a staple storage chamber within which the used staples may be retained to prevent them from being scattered about. However, the storage compartment of Viel increases the complexity and cost of his device.

SUMMARY OF THE INVENTION

It is an object to provide a prying staple remover which can retain a number of used staples for subsequent disposal.

A further object of this invention is to provide a staple remover in which removed staples do not interfere with the removal of subsequent staples.

A still further object of this invention is to provide a staple remover in accordance with the above identified objects which is further simple to operate and inexpensive to construct.

Briefly, a prying staple remover in accordance with the present invention includes a head portion having a curved bottom and top surface and a pair of side surfaces connecting the bottom surface to the top surface. The top and bottom surfaces meet at a flat, blunt prying tip, and the side surfaces are provided with side grooves which follow the curvature of the top surface.

The top surface includes a pair of rails separated by a recessed magnetic member which urges the base of a used staple against the rails. A handle portion is connected to the end of the head portion that is distal from the prying tip.

An advantage of this invention is that the used staples are retained to the head portion by two independent mechanisms, namely attraction to the magnetic member, and the engagement of the leg portions of the used staple with the side grooves of the head portion.

Another advantage of this invention is that the used staples retained on the head portion do not interfere with the subsequent removal of additional used staples due to the engagement of the leg portions of the used staples with the side grooves.

These and other objects and advantages of the present invention will no doubt become apparent upon a reading of the following descriptions and a study of the several figures of the drawing.

BRIEF DESCRIPTION OF THE DRAWING

FIG. 5 is a cross section view taken along line 5—5 of FIG. 2; and

FIGS. *6a*, *6b*, and *6c* illustrate the operation of the present device.

DETAILED DESCRIPTION OF THE PREFERRED EMBODIMENT(S)

Figure 1:
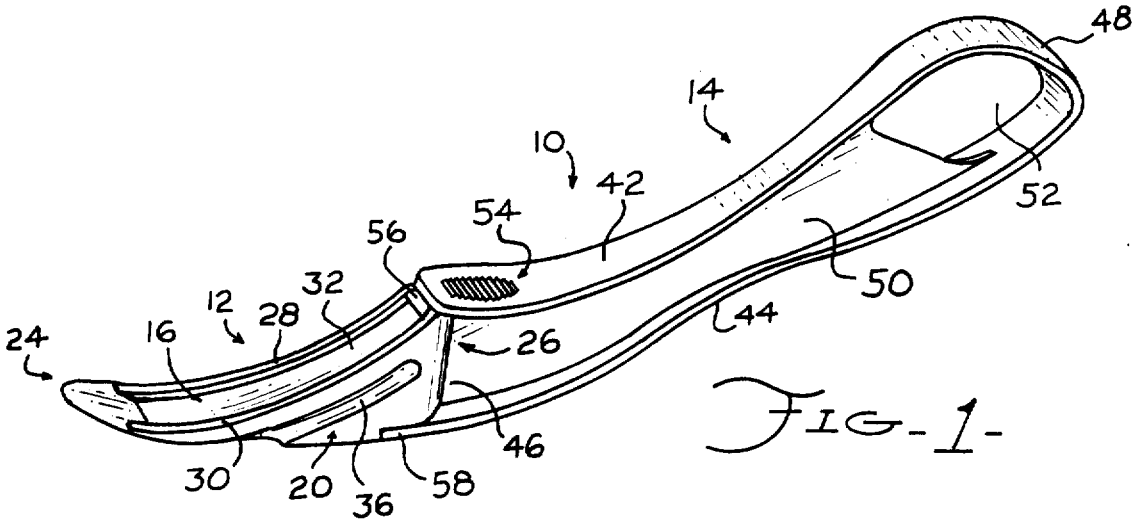
FIG. 1 is a perspective view of a prying staple remover in accordance with the present invention.
Figure 2:
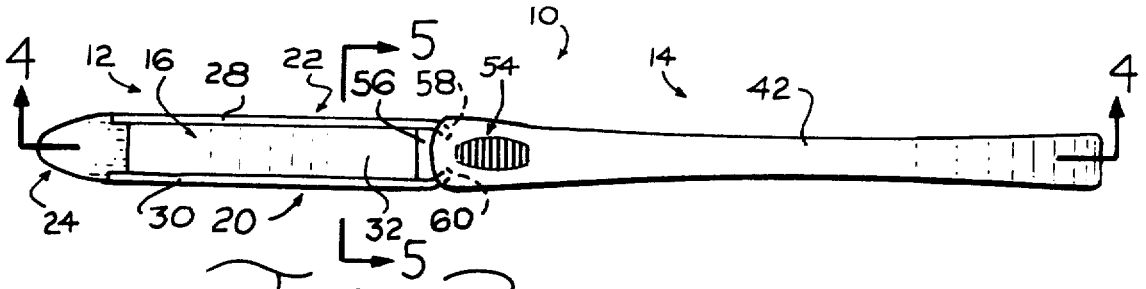
FIG. 2 is a top plan view of FIG. 1.
Figure 3:
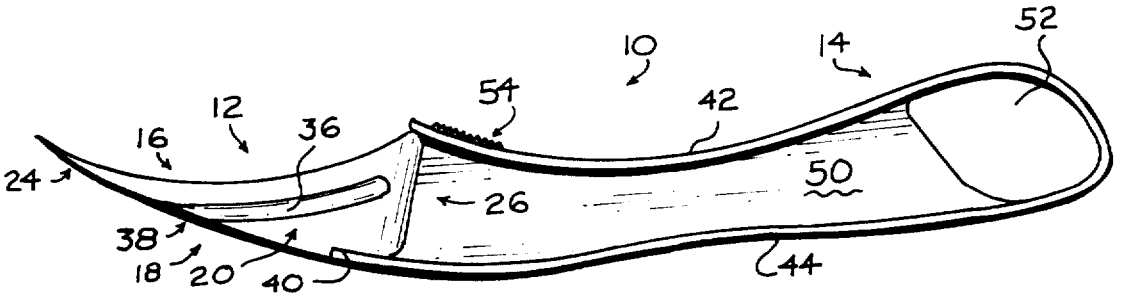
FIG. 3 is an elevational view of FIG. 1, the opposite elevational view being a mirror image thereof.
Figure 4:
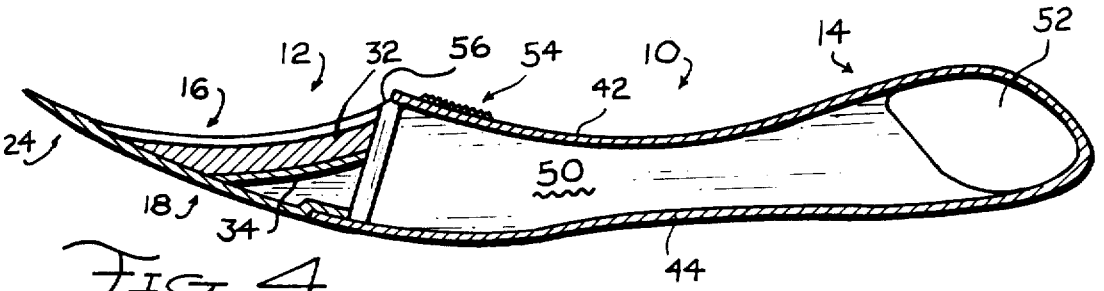
FIG. 4 is a cross section view taken along line 4—4 of FIG. 2.

Referring to FIGS. 1–5, a prying staple remover 10 in accordance with the present invention includes a head portion 12 and a handle portion 14. Head portion 12 includes a top surface 16, a bottom surface 18, and a pair of sides 20 an 22. Side 22, which is difficult to see except in FIG. 5, is a mirror image of side 20, such that a description of side 20 also serves as a description of side 22.

Top surface 16 and bottom surface 18 converge to a blunt prying tip 24 at one end, and diverge at a second end 26. As will be discussed in greater detail subsequently, handle portion 14 is attached to head portion 12 at second end 26.

Top surface 16 includes a pair of rails 28 and 30, and a recessed permanent magnet 32. Since head portion 12 is preferably made from a ferric material, sides 20 and 22 and rails 28 and 30 serve as magnetic field returns to intensify the magnetic field of magnet 32. A magnetic field return and support 34 is attached between sides 20 and 22 to provide an under support for magnetic 32 and to serve as a further magnetic field return. Thus, sides 20 and 22 and support 34 serve to focus the magnetic field produced by magnet 32 along the two rails 28 and 30.

Bottom surface 18 is preferably smoothly curved, and serves as a lever with a moveable fulcrum. As will be discussed in greater detail subsequently, when the prying tip 24 is engaged with a staple, surface 18 allows head portion 12 to rock rearwardly along the support surface to pull the staple from the object(s) to which it is attached.

Sides 20 and 22 are substantially mirror images of each other such that a description of side 20 also serves as a description of side 22. Sides 20/22 includes an arcuate recess or slot 36 which opens at 38 on bottom surface 18. As will be discussed subsequently, slot 36 of sides 20/22 allow used staples to move away from bottom surface 18 so as not to interfere with the removal of subsequent staples. Sides 20/22 are provided with a notch 40 receptive to a forward end of handle portion 14.

Handle portion 14 includes a top section 42, a bottom section 44, a forward section 46, a rearward section 48, and a web section 50. Web section 50 does not extend all the way to rearward section 48 such that an aperture 52 is provided in handle portion 14.

A small ridged area 54 is provided on top section 42 near its forward end to provide an enhanced grip for the unit. Forward section 46 forms a tongue 56 which extends between sides 20 and 22, and an extension 58 which engages notch 40 of head portion 12.

Handle portion 14 is preferably made out of plastic, although it can also be made out of metal or other materials. Head portion 12 can be attached to handle portion 14 in any number of conventional manners, including the swaging indicated at corners 58 and 60 of rails 28 and 30, respectively, adhesives, etc.

Referring now to FIG. *6a*, a staple S is shown engaged with a number of sheets of paper P. The prying tip 24 slides beneath the base portion of staple S to gently lift the legs of the staple from the papers P. A slight rocking and sliding motion exerted on prying staple remover 10 allows the bottom surface 18 to act as a lever with a removable fulcrum to increase the pressure exerted by the staple remover 10 on staple S.

As shown in FIG. *6b*, the staple S once it has been pried from paper P includes a base portion B and two leg portions L1 and L2. The leg portions L1 and L2 have a natural bend to them resulting from their earlier attachment to the papers P.

In FIG. *6c*, a plurality of staples S1, S2, S3, etc. are shown engaged with the slots 36 of sides 20/22. The staples S1, etc. are retained in position by magnetic attraction to magnet 32 and rails 28 and 30, and by the engagement of their legs L1 and L2 with the slots 36. As noted in FIG. 6, the staples that are engaged with slots 36 are spaced from the bottom surface 18 so as not to interfere with the subsequent removal of a new staple S.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A prying staple remover for staples having a base and two depending legs, said remover comprising:

a head portion having an arcuate bottom surface, an arcuate top surface, and a pair of side surfaces connecting said bottom surface to said top surface; said bottom surface having a greater radius of curvature than said top surface; said top surface including a pair of separated rails and a ferromagnetic member disposed between and recessed downwardly from said rails; said top surface and said bottom surface meeting at a blunt prying tip; said pair of side surfaces each including arcuate side grooves which follow the curvature of said top surface and which open on said bottom surface; whereby a base of a removed staple is magnetically attracted against said rails by said ferromagnetic member, and the legs of said staple are engaged with and channeled away from said bottom surface by said side grooves; and an arcuate handle portion connected to an end of said head portion that is distal from said prying tip.

2. A prying staple remover as recited in claim 1 wherein said head portion is made, at least in part, from a ferric material, such that said rails serve a part of a magnetic field return for said ferromagnetic member.

3. A prying staple remover as recited in claim 2 wherein said handle portion is made from a non-ferric material.

4. A prying staple remover as recited in claim 3 wherein said handle portion is provided with a thumb grip on an upper surface thereof proximate its juncture with said head portion.

* * * * *